US011415275B1

(12) United States Patent
Shan et al.

(10) Patent No.: US 11,415,275 B1
(45) Date of Patent: Aug. 16, 2022

(54) LED LIGHT STRING WITH SINGLE WIRE AND ILLUMINATION DEVICE

(71) Applicant: Zhuhai Bojay Electronics Co. Ltd., Guangdong (CN)

(72) Inventors: Xiwan Shan, Guangdong (CN); Tuxiu Yang, Guangdong (CN); Qunlin Li, Guangdong (CN); Yundong Ai, Guangdong (CN); Jie Zhang, Guangdong (CN); Jingtian Wu, Guangdong (CN); Hua He, Guangdong (CN); Qiming Liu, Guangdong (CN); Yue Chen, Guangdong (CN); Su Yan, Guangdong (CN)

(73) Assignee: Zhuhai Bojay Electronics Co. Ltd.

( * ) Notice: Subject to any disclaimer, the term of this patent is extended or adjusted under 35 U.S.C. 154(b) by 0 days.

(21) Appl. No.: 17/460,785

(22) Filed: Aug. 30, 2021

(30) Foreign Application Priority Data

May 26, 2021 (CN) ..... 202110577412.1

(51) Int. Cl.
*F21S 4/10* (2016.01)
*F21V 21/002* (2006.01)
(Continued)

(52) U.S. Cl.
CPC ..... *F21S 4/10* (2016.01); *F21V 21/002* (2013.01); *F21V 23/002* (2013.01); *F21S 4/22* (2016.01);
(Continued)

(58) Field of Classification Search
CPC ..... F21S 4/10; F21S 4/15; F21S 4/22; F21S 4/24; F21S 4/26; F21V 23/001;
(Continued)

(56) References Cited

U.S. PATENT DOCUMENTS 6,388,195 B1 * 5/2002 Studer ..... H01B 3/427 174/120 R
7,901,263 B2 3/2011 Tsai
(Continued)

FOREIGN PATENT DOCUMENTS

CN 201688230 U 12/2010
CN 203560768 U 4/2014
(Continued)

OTHER PUBLICATIONS

U.S. Appl. No. 16/888,222 Non-Provisional Application, filed May 29, 2020, 29 pages.
(Continued)

*Primary Examiner* — Colin J Cattanach
(74) *Attorney, Agent, or Firm* — Adsero IP

(57) ABSTRACT

An LED light string with single wire. The LED light string includes one wire including a composite wire core, and a plurality of light bodies. The composite wire core is composed of at least one first conductor layer extending in an axial direction of the wire, at least one second conductor layer extending in the axial direction of the wire, and an insulation layer therebetween. The plurality of light bodies arranged spaced away at set intervals along the axial direction of the wire. Each of the light bodies includes at least one patch LED light-emitting part and an encapsulation colloid coated on a surface of the at least one patch LED light-emitting part. A positive electrode and a negative electrode of the at least one patch LED light-emitting part being electrically connected to the at least one first conductor layer and the at least one second conductor layer, respectively.

14 Claims, 13 Drawing Sheets

(51) Int. Cl.

| | |
|---|---|
| ***F21V 23/00*** | (2015.01) |
| ***F21S 4/24*** | (2016.01) |
| ***F21S 4/26*** | (2016.01) |
| ***H01B 7/00*** | (2006.01) |
| ***F21S 4/22*** | (2016.01) |

(52) U.S. Cl.
CPC .. *F21S 4/24* (2016.01); *F21S 4/26* (2016.01); *F21V 23/001* (2013.01); *F21V 23/004* (2013.01); *F21V 23/005* (2013.01); *F21V 23/006* (2013.01); *F21V 23/007* (2013.01); *F21V 23/008* (2013.01); *H01B 7/0009* (2013.01); *H01B 7/0018* (2013.01); *H01B 7/0036* (2013.01)

(58) Field of Classification Search
CPC .... F21V 23/002; F21V 23/004; F21V 23/005; F21V 23/006; F21V 23/007; F21V 23/008; H01B 7/0009; H01B 7/0018; H01B 7/0036
See application file for complete search history.

(56) References Cited

U.S. PATENT DOCUMENTS

| | | | | |
|---|---|---|---|---|
| 7,926,978 | B2 | 4/2011 | Tsai | |
| 10,281,094 | B2 | 5/2019 | Liu | |
| 10,578,260 | B1 * | 3/2020 | Chen | F21V 21/002 |
| 10,711,954 | B2 * | 7/2020 | Chen | H01R 13/627 |
| 10,845,036 | B2 * | 11/2020 | Shao | F21V 31/005 |
| 10,907,781 | B2 | 2/2021 | Shao | |
| 10,920,941 | B1 | 2/2021 | Shan et al. | |
| 10,982,828 | B1 * | 4/2021 | Chen | A47G 33/06 |
| 11,118,743 | B2 | 9/2021 | Shan et al. | |
| 11,204,140 | B2 | 12/2021 | Shan et al. | |
| 2002/0089859 | A1 | 7/2002 | Jackson et al. | |
| 2005/0207151 | A1 | 9/2005 | Aanegola et al. | |
| 2007/0208395 | A1 | 9/2007 | Leclerc et al. | |
| 2008/0200089 | A1 | 8/2008 | Tsai | |
| 2010/0141161 | A1 * | 6/2010 | Hering | H05B 45/42 315/185 S |
| 2010/0157598 | A1 * | 6/2010 | Tsai | F21V 21/002 362/382 |
| 2011/0034101 | A1 * | 2/2011 | Tsai | F21K 9/00 445/23 |
| 2011/0109242 | A1 * | 5/2011 | Wang | F21V 23/06 315/294 |
| 2011/0310601 | A1 | 12/2011 | Shao | |
| 2014/0009074 | A1 | 1/2014 | Chen | |
| 2014/0268818 | A1 | 9/2014 | Huang et al. | |
| 2015/0077999 | A1 * | 3/2015 | Chen | F21S 4/15 174/72 R |
| 2015/0159844 | A1 * | 6/2015 | Flaherty | F21S 4/10 362/249.02 |
| 2016/0341408 | A1 * | 11/2016 | Altamura | H01L 33/486 |
| 2017/0194077 | A1 * | 7/2017 | Cao | H01B 3/421 |
| 2017/0284614 | A1 * | 10/2017 | Pan | F21S 4/10 |
| 2017/0328527 | A1 | 11/2017 | Yang et al. | |
| 2017/0336037 | A1 | 11/2017 | Chien | |
| 2018/0119929 | A1 | 5/2018 | Weiss | |
| 2018/0209595 | A1 | 7/2018 | Liu | |
| 2019/0069649 | A1 | 3/2019 | Qin | |
| 2019/0101254 | A1 | 4/2019 | Tsai | |
| 2019/0234597 | A1 | 8/2019 | Zhu | |
| 2019/0277458 | A1 | 9/2019 | Shao | |
| 2019/0368670 | A1 | 12/2019 | Gao | |
| 2019/0376669 | A1 | 12/2019 | Shao et al. | |
| 2020/0278091 | A1 | 9/2020 | Chen et al. | |
| 2020/0383690 | A1 | 12/2020 | Sun | |
| 2021/0071827 | A1 | 3/2021 | Shan et al. | |
| 2021/0071828 | A1 | 3/2021 | Shan et al. | |
| 2021/0071829 | A1 | 3/2021 | Shan et al. | |
| 2021/0071850 | A1 | 3/2021 | Shan et al. | |
| 2021/0071852 | A1 | 3/2021 | Shan et al. | |
| 2021/0071854 | A1 | 3/2021 | Shan et al. | |

FOREIGN PATENT DOCUMENTS

| | | | | |
|---|---|---|---|---|
| CN | 203571516 | U | 4/2014 | |
| CN | 203771161 | U | 8/2014 | |
| CN | 204026296 | U * | 12/2014 | F21S 4/10 |
| CN | 204328616 | U | 5/2015 | |
| CN | 205535227 | U | 8/2016 | |
| CN | 206496230 | U | 9/2017 | |
| CN | 107559646 | A | 1/2018 | |
| CN | 207539677 | U | 6/2018 | |
| CN | 110617414 | A | 12/2019 | |
| EP | 2023034 | A1 | 2/2009 | |
| EP | 3599415 | A1 | 1/2020 | |
| GB | 2586903 | A | 6/2020 | |
| KR | 10-1629749 | B1 | 6/2016 | |
| WO | WO-2014-062061 | A1 | 4/2014 | |
| WO | WO-2019-041745 | A1 | 3/2019 | |

OTHER PUBLICATIONS

U.S. Appl. No. 16/888,282 Non-Provisional Application, filed May 29, 2020, 36 pages.
U.S. Appl. No. 16/888,286 Non-Provisional Application, filed May 29, 2020, 36 pages.
U.S. Appl. No. 16/888,290 Non-Provisional Application, filed May 29, 2020, 31 pages.
U.S. Appl. No. 16/888,296 Non-Provisional Application, filed May 29, 2020, 39 pages.
GB Application No. GB2006270.9, Examination Report dated Jun. 12, 2020, 1 page.
GB Application No. GB2006270.9, Search Report dated Jun. 11, 2020, 1 page.
U.S. Appl. No. 17/002,105 Non-Provisional Application, filed Aug. 25, 2020, 72 pages.
GB Application No. GB2006267.5, Examination Report dated Jun. 12, 2020, 2 pages.
GB Application No. GB2007273.2, Examination Report dated Jun. 15, 2020, 2 pages.
GB Application No. GB2006271.7, Examination Report dated Jun. 12, 2020, 2 pages.
U.S. Appl. No. 16/888,290 Notice of Allowance, dated Nov. 13, 2020, 20 pages.
U.S. Appl. No. 16/888,222 Non-Final Office Action, dated Dec. 16, 2020, pages.
U.S. Appl. No. 16/888,282 Office Action-Restriction Requirement, dated Dec. 18, 2020, 7 pages.
U.S. Appl. No. 16/888,286 Non-Final Office Action dated Jan. 27, 2021, 27 pages.
U.S. Appl. No. 16/888,282 Non-Final Office Action, dated Mar. 8, 2021, 95 pages.
Extended European Search Report, Application No. 20194300.8, dated Feb. 9, 2021, 8 pages.
U.S. Appl. No. 16/888,222 Notice of Allowance, dated May 18, 2021, 36 pages.
U.S. Appl. No. 16/888,286 Final Office Action dated Jul. 16, 2021, 28 pages.
U.S. Appl. No. 16/888,296 Office Action Restriction Requirement, dated Jul. 16, 202', 6 pages.
Canadian Application No. 3080041, Office Action, dated Jun. 29, 2021, 6 pages.
Canadian Application No. 3,089,796, Office Action, dated Jun. 25, 2021, 5 pages.
U.S. Appl. No. 16/888,286 Notice of Allowance, dated Sep. 22, 2021, 30 pages.
U.S. Appl. No. 16/888,296 Non-Final Office Action, dated Sep. 27, 2021, 54 pages.
U.S. Appl. No. 16/888,282 Final Office Action, dated Sep. 30, 2021, 30 pages.
U.S. Appl. No. 16/888,282 Notice of Allowance, dated Dec. 17, 2021, 33 pages.
Canadian Application No. 3,081,297, Office Action, dated Jul. 7, 2021, 4 pages.

(56) References Cited

OTHER PUBLICATIONS

European Search Report, EP Application No. 21193007.8, European Patent Office, dated Feb. 17, 2022, 7 pages.

* cited by examiner

LED LIGHT STRING WITH SINGLE WIRE AND ILLUMINATION DEVICE

CROSS REFERENCE TO RELATED APPLICATIONS

This application claims priority to Chinese Patent Application No. 2021105774121, filed on May 26, 2021, and entitled "LED LIGHT STRING WITH SINGLE WIRE AND ILLUMINATION DEVICE", the contents of which are incorporated herein in entirety by reference.

TECHNICAL FIELD

The present disclosure relates to the technical field of illumination, and more particular to a LED light string with single wire and to an illumination device.

BACKGROUND

LED lights have been widely used due to their small size, low power consumption, long service life, high brightness, low heat, and environmental friendly. With the development of LED technology, the variety of LED lights is increasing. As a LED product, the LED light string is not only used for a scene decoration for various festivals such as Christmas Day, but also used for home decorations, urban lighting projects and various entertainment places. Compared with the conventional light, the LED light has advantages of being colorful, a diversified in color, and reduced energy consumption. In addition, the seven-color color-changing light, which are composed by the LED lights, can not only serve illumination, but also increase the festive atmosphere for different programs and different occasions due to its decorative effect.

The existing LED light string generally consists of more than two wires arranged in parallel, a plurality of patch LEDs mounted on the wires at certain intervals along the length direction of the wire, and encapsulation colloids for encapsulating the patch LEDs. The more than two wires are independent enameled wires or wires with rubber sheath connected by insulation rubber sheath. The LED light string is large in size, heavy in weight, low in flexibility, and not suitable for use in fine applications such as display panels, which are limited by the sizes of the wires and patch LEDs thereof. In order to solve this problem, the existing LED light string reduced the diameter of the wires and the size of the patch LEDs to reduce the volume of the LED light string, for example in the CN209926070U China Patent. However, in order to ensure the strength requirement of LED light string, the reduced diameter range of the wires must be limited, and therefore, the reduced volume of the LED light string is limited. In addition, the cost of the existing LED light string is high.

SUMMARY

In view of prior art described above, a technical problem to be solved by the present disclosure is to provide an LED light string of with single wire having a small size and a light weight. Another technical problem to be solved by the present disclosure is to provide an illumination device using the LED light string with single wire.

In order to solve the above technical problems, the present disclosure provides an LED light string with single wire. The LED light string includes one wire including a composite wire core, and a plurality of light bodies. The composite wire core is composed of at least one first conductor layer extending in an axial direction of the wire, at least one second conductor layer extending in the axial direction of the wire, and an insulation layer therebetween. The plurality of light bodies arranged spaced away at set intervals along the axial direction of the wire. Each of the light bodies includes at least one patch LED light-emitting part and an encapsulation colloid coated on a surface of the at least one patch LED light-emitting part. A positive electrode and a negative electrode of the at least one patch LED light-emitting part being electrically connected to the at least one first conductor layer and the at least one second conductor layer, respectively.

The LED light string with single wire of the present disclosure employs the composite wire instead of the traditional enameled wires or wires with rubber sheath. The conductor layers and the insulation layer of the composite wire are integrally composed together. Compared with the traditional enameled wires or wires with rubber sheath, the composite wire core has smaller cross-sectional area and lighter weight, which can greatly reduce the size and weight of the LED light string, improve the quality of the LED light string, and expand the application of the LED light string.

In an embodiment, the at least one first conductor layer and the at least one second conductor layer are arranged in a direction perpendicular to the axial direction of the wire In an embodiment, the at least one patch LED light-emitting part of the light body are located on same side or on opposite sides of the composite wire core, respectively; the polarities of the positive electrodes of the patch LED light-emitting parts on the same side are identical or opposite, and the polarities of the negative electrodes of the patch LED light-emitting parts on the same side are identical or opposite.

In an embodiment, the at least one first conductor layer and the at least one second conductor layer are arranged in a circumferential direction centered on a central axis of the wire.

In an embodiment, each of the light bodies comprises two or more patch LED light-emitting parts; and the two or more patch LED light-emitting parts are arranged in the circumferential direction centered on the central axis of the wire.

In an embodiment, the at least one first conductor layer and the at least one second conductor layer are arranged coaxially from inside out and from a central axis of the wire.

In an embodiment, a portion, which locates on one or both sides of the central axis of the wire and corresponds to the position of the light body, of the composite wire core is profiled along the axial direction of the wire, to show the first conductor layer and the second conductor layer to form a first welding portion and a second welding portion, respectively; the positive electrode and the negative electrode of the patch LED light-emitting part are electrically connected to the first welding portion and the second welding portion, respectively.

In an embodiment, the cross-section of the composite wire core is circular, elliptical, polygonal, or rectangular.

In an embodiment, a surface of the patch LED light-emitting part facing the composite wire core is provided with a recess that matches the surface shape of the composite wire core.

In an embodiment, the materials of the first conductor layer and the second conductor layer are Cu, Al, Ag, or an alloy thereof, and the material of the insulation layer is a non-metal or a metal oxide.

In an embodiment, the wire further comprises an insulation sheath coated on part or all of a surface of the composite wire core.

In an embodiment, the material of the insulation sheath is insulation paint or insulation plastic.

In an embodiment, the patch LED light-emitting part is a LED, an ICLED, or a HVLED.

In an embodiment, the LED light string with single wire further includes a plurality of decorative parts. The plurality of decorative parts are partially or fully transparent or translucent, and are coated on the plurality of light bodies, respectively.

In another embodiment of the present disclosure, an illumination device is provided, which includes a control box and an LED light string with single wire described above. A positive electrode output and a negative electrode output of the control box are electrically connected to the first conductor layer and the second conductor layer of the LED light string, respectively.

In an embodiment, the control box comprises a connection circuit board provided with at least one first connection line, at least one second connection line, and a through hole. An inner wall of the through hole is provided with at least one first conductive portion conducting to the at least one first connection line and at least one second conductive portion conducting to the at least one second connection line. One end of the wire of the LED light string is inserted into the through hole, and the at least one first conductor layer and the at least one second conductor layer of the wire are welded to the at least one first conductive portion and the at least one second conductive portion, respectively.

The additional technical features and advantages therefrom of the present disclosure will be described in the embodiments of the specification.

DESCRIPTION OF REFERENCE SIGNS

Figure 1:
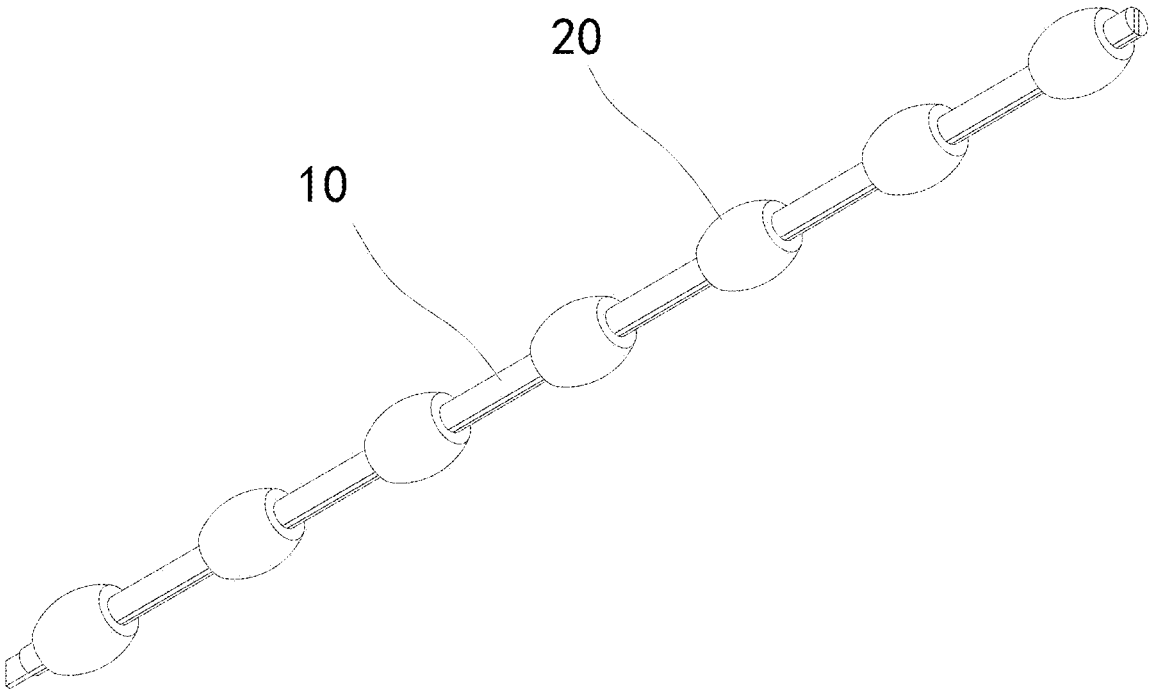
FIG. 1 is an axial view of a LED light string with single wire according to a first embodiment of the present disclosure.

10. wire; 11. composite wire core; 111. first conductor layer; 112. second conductor layer; 113. insulation layer; 114. first welding portion; 115. second welding portion; 12. insulation sheath; 20. light body; 21. patch LED light-emitting part; 211. positive electrode; 212. negative electrode; 213. recess; 22. encapsulation colloid; 30. control box; 31. connection circuit board; 311. through hole; 312. first conductive portion; 313. second conductive portion.

DETAILED DESCRIPTION

The present disclosure will now be described in detail with reference to the accompanying drawings and in connection with the embodiments. It should be noted that the following embodiments and features therein can be combined with each other without conflict.

In the specification, the locational words such as "front", "back", "upper" and "lower" are defined by the position of the parts in the drawing as well as the relative positions of the parts therebetween, and are merely used for explaining the technical solutions clearly and conveniently. It should be understood that the use of these locational words should not limit the scope protection of the present disclosure.

Figure 2:
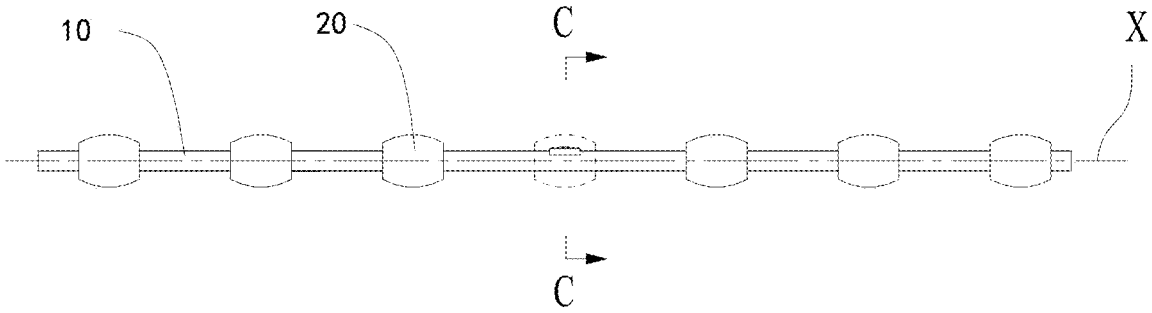
FIG. 2 is a front view of the LED light string with single wire shown in FIG. 1.
Figure 3:
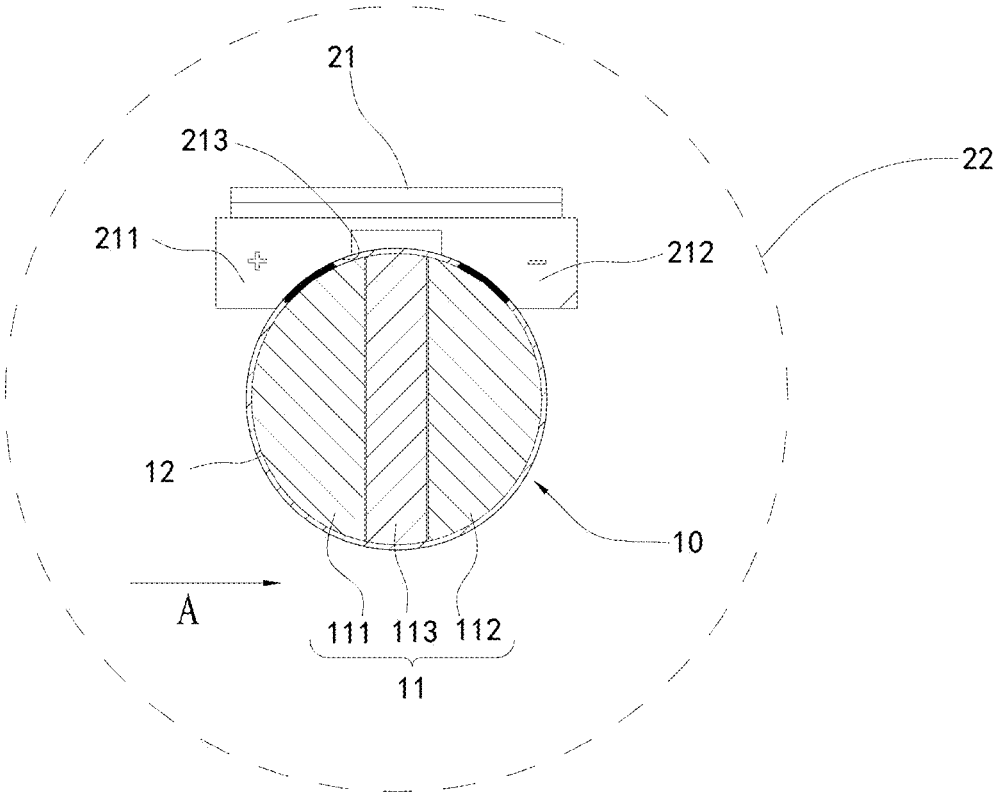
FIG. 3 is a cross-sectional view along line C-C in FIG. 2.
Figure 4:
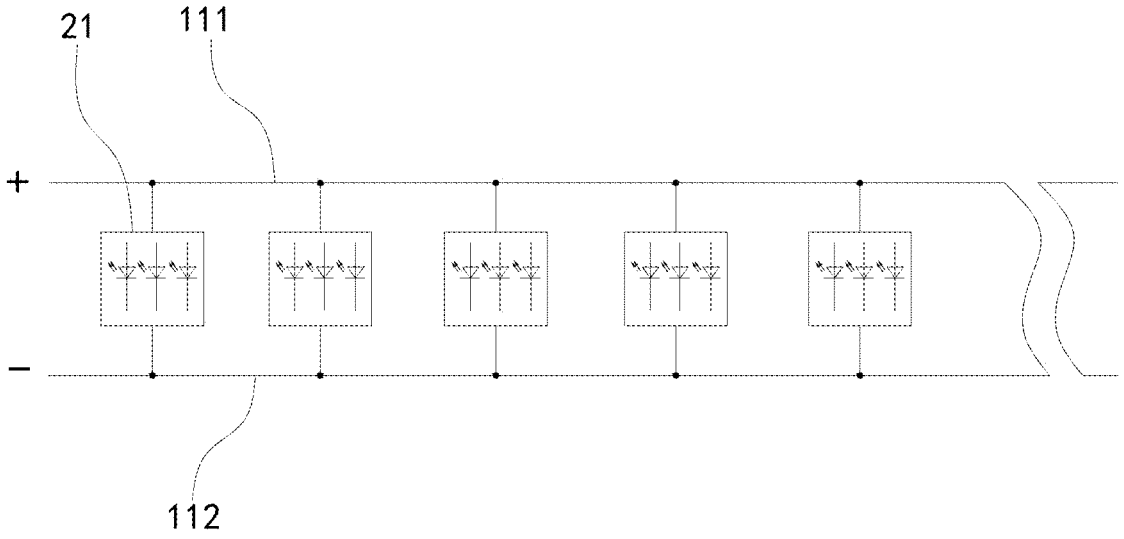
FIG. 4 is a schematic circuit diagram of the LED light string with single wire shown in FIG. 1.

FIG. 1 is an axial view of a LED light string with single wire according to a first embodiment of the present disclosure; FIG. 2 is a front view of the LED light string with single wire shown in FIG. 1; FIG. 3 is a cross-sectional view along line C-C in FIG. 2, and FIG. 4 is a schematic circuit diagram of the LED light string with single wire shown in FIG. 1. As shown in FIGS. 1 to 4, in a first embodiment, a LED light string with single wire includes one wire 10 and a plurality of light bodies 20 arranged at intervals along an axis direction of the wire 10.

The wire 10 has a central axis X and includes a composite wire core 11. The composite wire core 11 includes at least one first conductor layer 111 extending along the central axis X, at least one second conductor layer 112 extending along the central axis X, and an insulation layer 113 between the first conductor layer 111 and the second conductor layer 112. The materials of the first conductor layer 111 and the second conductor layer 112 can be Cu, Al, Ag, or an alloy thereof. The material of the insulation layer 113 can be a non-metal or a metal oxide. The metal oxide can be an oxide of one or more metal elements of Ni, Nb, Cr, Fe, Al, Zr, Ti, V, W, Mo, Cu. Compared with traditional enameled wires or wires with rubber sheath, the composite wire core 11 has smaller cross-sectional area and lighter weight, which can greatly reduce the size and weight of the LED light string, improve the quality of the LED light string, and expand the application of the LED light string.

In the present embodiment, the at least one first conductor layer 111 and the at least one second conductor layer 112 are arranged in a direction perpendicular to the central axis X (i.e., the direction indicated by arrow A in FIG. 3). As an example, the number of the first conductor layer 111, the second conductor layer 112, and the insulation layer 113 is one, respectively. The cross-section of the insulation layer 113 is "straight line" shape. The cross-sectional shapes of the first conductor layer 111 and the second conductor layer 112 are approximately semicircular, respectively. The first conductor layer 111 and the second conductor layer 112 are arranged opposite to each other on both sides of the insulation layer 113, so that the cross-sectional shape of the composite wire core 11 is circular. The cross-sectional shape of the composite wire core 11 can also be elliptical, polygonal, or rectangular.

Preferably, in order to prevent the current leakage caused by the first conductor layer 111 and the second conductor layer 112 contacting other conductive objects, in an embodiment, the wire 10 further includes an insulation sheath 12 coated on part or all of the surface of the composite wire core 11. The material of the insulation sheath 12 can be insulation paint or insulation plastic. It should be noted that, in the present embodiment, since the two conductor layers have been separated from each other by the insulation layer 113, there is no short circuit between the two conductor layers, and therefore, the insulation sheath 12 can be omitted for some applications that do not have high requirement for current leakage.

A plurality of light bodies 20 (as an example, in an embodiment, the number of the light bodies 20 is seven) are arranged at intervals along the central axis X. Each light body 20 includes at least one patch LED light-emitting part 21 and an encapsulation colloid 22 coated on the surface of the at least one patch LED light-emitting part 21. A positive electrode 211 and a negative electrode 212 of the at least one patch LED light-emitting part 21 are electrically connected to the at least one first conductor layer 111 and the at least one second conductor layer 112, respectively. In the present embodiment, each light body 20 includes one or more patch LED light-emitting parts 21 located on one side of the composite wire core 11. The positive electrode 211 and the negative electrode 212 of the patch LED light-emitting part 21 are electrically connected to the first conductor layer 111 and the second conductor layer 112 by laser welding, respectively.

Preferably, a surface of the patch LED light-emitting part 21 facing the composite wire core 11 is provided with a recess 213 that matches the surface shape of the composite wire core 11, so that the patch LED light-emitting part 21 and the composite wire core 11 can be closely adhered together and the volume of the light body is smaller.

In the present embodiment, the patch LED light-emitting part 21 is an integrated-circuit LED (ICLED). By directly encapsulating the IC within a LED with standard size, the process difficulty is reduced in manufacturing, the additional space required for independently and externally disposing the IC is omitted in volume, and the control capability of the controllable single-point and full color is satisfied in color. The ICLED includes a built-in carrier signal processing module. There are two manners for transmitting the control signal of the ICLED. In one manner, a waveform is loaded on the first conductor layer 111 and the second conductor layer 112, and a signal is transmitted, and therefore, the power and the signal are transmitted on the same wire. In another manner, the insulation layer 113 employs a metal oxide insulation material and a waveform is loaded thereon, to transmit a signal. The patch LED light-emitting part 21 can also be a common monochrome LED, such as a white LED, a blue LED, a flash LED, or the like. In addition, the patch LED light-emitting part 21 can also be a high voltage LED (HVLED).

The encapsulation colloid 22 can be UV glue or common curing glue. The cross-sectional profile of the encapsulation colloid 22 can be circular, elliptical, square, or the like.

Preferably, the LED light string with single wire also includes a plurality of decorative parts (not shown), which are partially or fully transparent or translucent, and are coated on the plurality of light bodies. The decorative parts can increase the product aesthetic and protect the light bodies. The decorative parts can be integrated with the LED light string directly by injection molding. Alternatively, the LED light string can be manufactured in advance and then the decorative parts are assembled with the LED light string.

Figure 5:
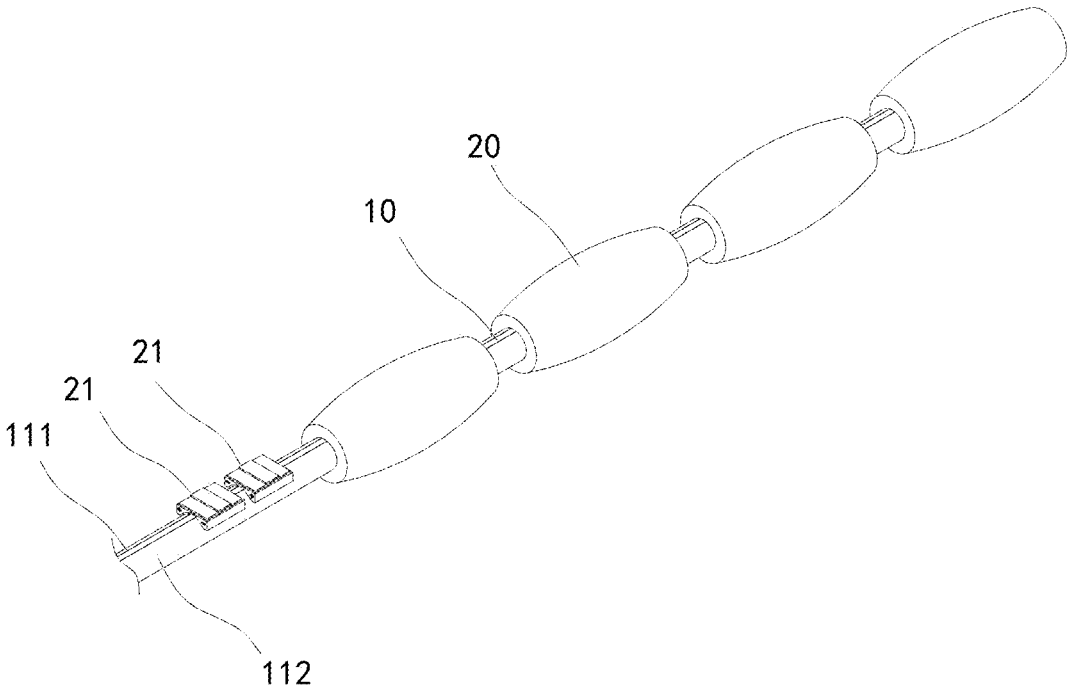
FIG. 5 is an axial view of a LED light string with single wire according to a second embodiment of the present disclosure.

FIG. 5 is an axial view of a LED light string with single wire according to a second embodiment of the present disclosure. As shown in FIG. 5, in the present embodiment, each light body 20 includes two patch LED light-emitting parts 21, which are located on the same side of the composite wire core 11 along the central axis X. The polarities of the positive electrode 211 and the negative electrode 212 of one patch LED light-emitting part 21 are opposite to that of another patch LED light-emitting part 21, respectively. In this way, when the LED light string is powered in a forward direction (i.e., the first conductor layer 111 is connected to a positive electrode of a power supply, and the second conductor layer 112 is connected to a negative electrode of the power supply), the patch LED light-emitting part 21 located on the left side emits light, but the patch LED light-emitting part 21 located on the right side does not emit light. When the LED light string is powered in a reverse direction (i.e., the first conductor layer 111 is connected to the negative electrode of the power supply, and the second conductor layer 112 is connected to the positive electrode of the power supply), the patch LED light-emitting part 21 located on the right side emits light, but the patch LED light-emitting part 21 located on the left side does not emit light, so that an universal-polarity effect is achieved and the usage is facilitated.

Figure 6:
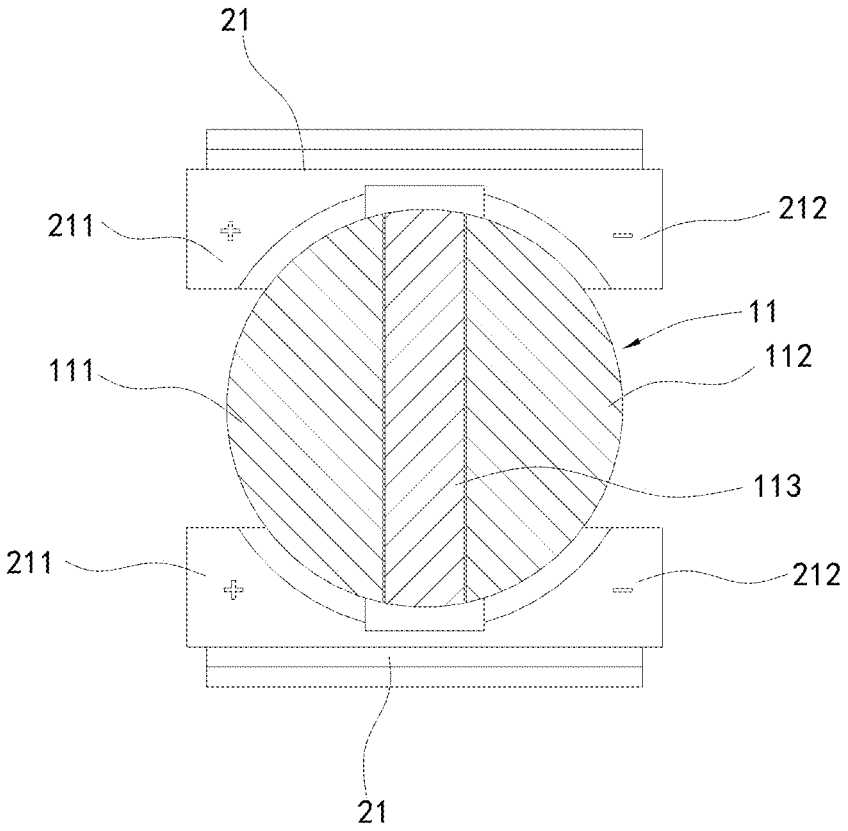
FIG. 6 is a cross-sectional view of a LED light string with single wire omitting an encapsulation colloid according to a third embodiment of the present disclosure.

FIG. 6 is a cross-sectional view of a LED light string with single wire omitting the encapsulation colloid according to a third embodiment of the present disclosure. As shown in FIG. 6, in the present embodiment, each light body 20 includes two patch LED light-emitting parts 21, which are located on both opposite sides of the composite wire core 11. In this way, the light emission area of the LED can be increased, the brightness of the light bodies 20 can be increased, and the utilization rate of the wire can also be improved. In the present embodiment, in each light body 20, the polarities of the two patch LED light-emitting parts 21 are identical, respectively. That is, the positive electrodes 211 of the two patch LED light-emitting parts 21 are both electrically connected to the first conductor layer 111, and the negative electrodes 212 of the two patch LED light-emitting parts 21 are both electrically connected to the second conductor layer 112. Alternatively, in each light body 20, the polarities of the two patch LED light-emitting part 21 can be opposite. That is, the positive electrode 211 of one patch LED light-emitting part 21 is electrically connected to the first conductor layer 111, and the negative electrode 212 thereof is electrically connected to the second conductor layer 112. The positive electrode 211 of another patch LED light-emitting part 21 is electrically connected to the second conductor layer 112, and the negative electrode 212 is electrically connected to the first conductor layer 111.

Figure 7:
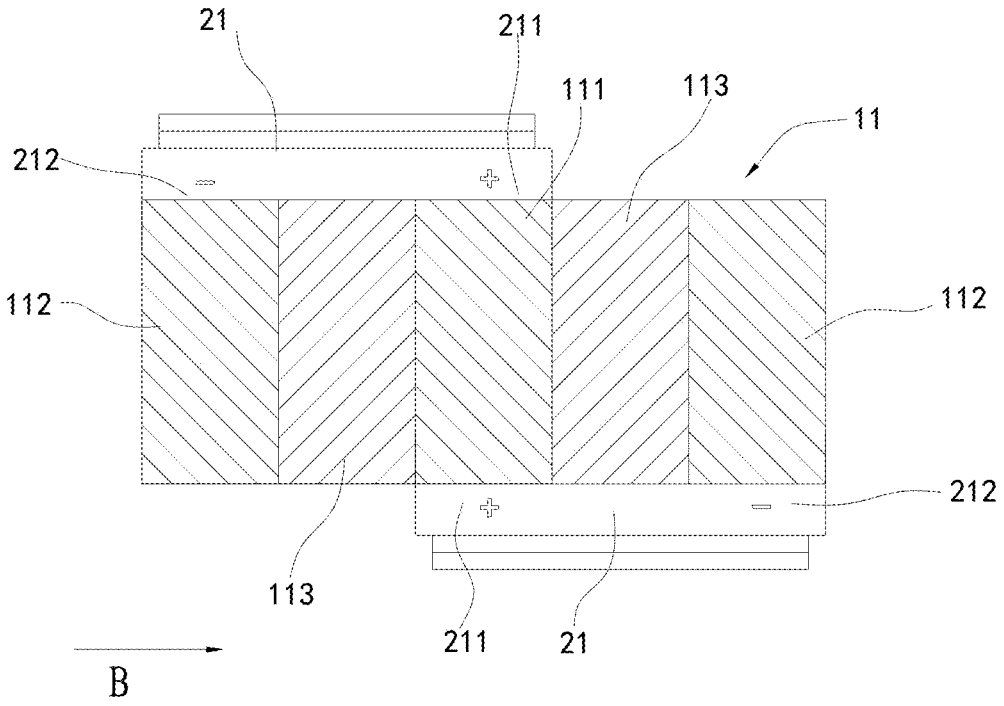
FIG. 7 is a cross-sectional view of a LED light string with single wire omitting an encapsulation colloid according to a fourth embodiment of the present disclosure.

FIG. 7 is a cross-sectional view of a LED light string with single wire omitting the encapsulation colloid 22 according to a fourth embodiment of the present disclosure. As shown in FIG. 7, in the present embodiment, the cross-section of the composite wire core 11 is rectangular. The Composite wire core 11 includes one first conductor layer 111, two second conductor layers 112, and insulation layers 113 between the first conductor layer 111 and the second conductor layers 112, respectively. The one first conductor layer 111 and the two second conductor layers 112 are arranged in a direction perpendicular to the central axis X (i.e., the direction indicated by arrow B in FIG. 7). Each light body 20 includes two patch LED light-emitting part 21, the positive electrodes 211 (or negative electrodes 212) of the two patch LED light-emitting parts 21 are both electrically connected to the first conductor layer 111, and the negative electrodes 212 (or positive electrodes 211) of the two patch LED light-emitting parts 21 are electrically connected to the two second conductor layers 112, respectively. In addition, the colors of the two patch LED light-emitting parts 21 are be set to be different.

Figure 8:
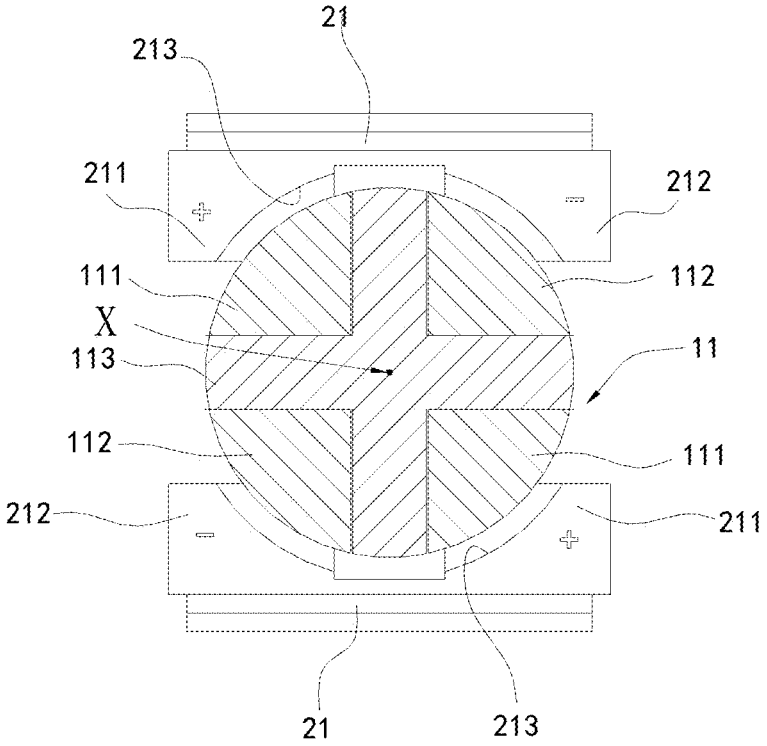
FIG. 8 is a cross-sectional view of a LED light string with single wire omitting an encapsulation colloid according to a fifth embodiment of the present disclosure.

FIG. 8 is a cross-sectional view of a LED light string with single wire omitting the encapsulation colloid 22 according to a fifth embodiment of the present disclosure. As shown in FIG. 5, the structure of the LED light string with single wire in the present embodiment is substantially the same as that of the LED light string in the third embodiment, except that at least one first conductor layer 111 and at least one second conductor layer 112 are arranged along a circumferential direction centered on the central axis X. As an example, the cross-section of the composite wire core 11 is circular. The number of the first conductor layers 111 is two, and the number of the second conductor layers 112 is two. The cross-sections of the first conductor layer 111 and the second conductor layer 112 are both a sector shape with 90 degrees. The cross-section of the insulation layer 113 is a cross shape. Each light body 20 includes two patch LED light-emitting parts 21, which are arranged along the circumferential direction centered on the central axis X. The positive electrode 211 and the negative electrode 212 of one patch LED light-emitting part 21 are welded to one first conductor layer 111 and one first conductor layer 111, respectively, and the positive electrode 211 and the negative electrode 212 of another patch LED light-emitting part 21 are welded to another first conductor layer 111 and another first conductor layer 111, respectively. Compared with the second embodiment, in the case of same diameter, in the present embodiment, the LED light string can independently control two patch LED light-emitting parts 21 in the light bodies 20.

Figure 9:
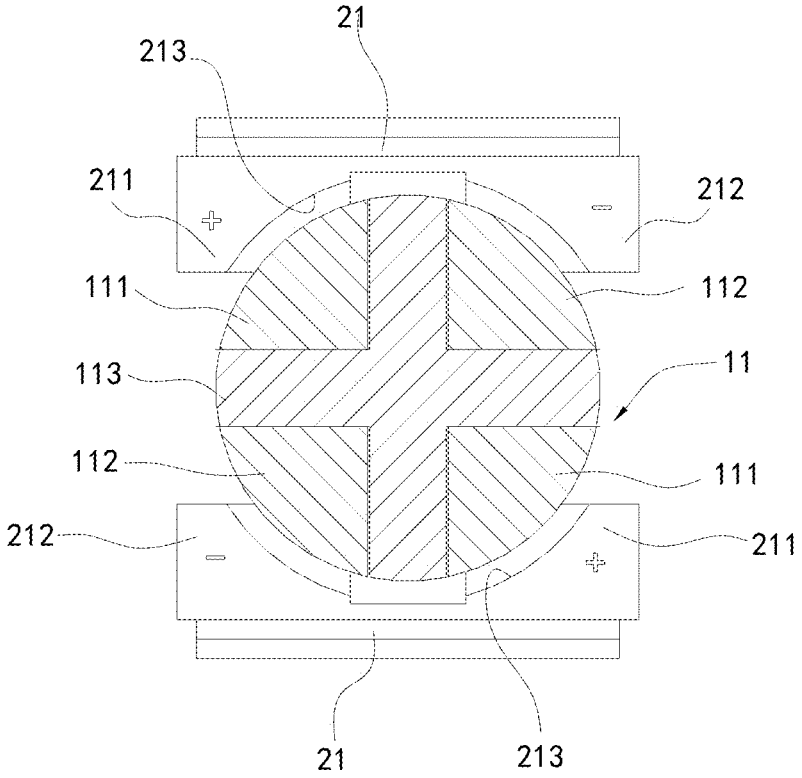
FIG. 9 is a cross-sectional view of a LED light string with single wire omitting an encapsulation colloid according to a sixth embodiment of the present disclosure.

FIG. 9 is a cross-sectional view of a LED light string with single wire omitting the encapsulation colloid 22 according to a sixth embodiment of the present disclosure. As shown in FIG. 9, the structure of the LED light string with single wire in the present embodiment is substantially the same as that of the LED light string in the fifth embodiment, except that the polarities of the positive electrode 211 and the negative electrode 212 of the two patch LED light-emitting parts 21 are opposite, respectively. When the LED light string is powered in the forward direction, a first patch LED light-emitting part 21 emits light, but a second patch LED light-emitting part 21 does not emit light. When the LED light string is powered in the reverse direction, the second patch LED light-emitting part 21 emits light, but the first patch LED light-emitting part 21 does not emit light, so that the universal-polarity effect is achieved.

Figure 10:
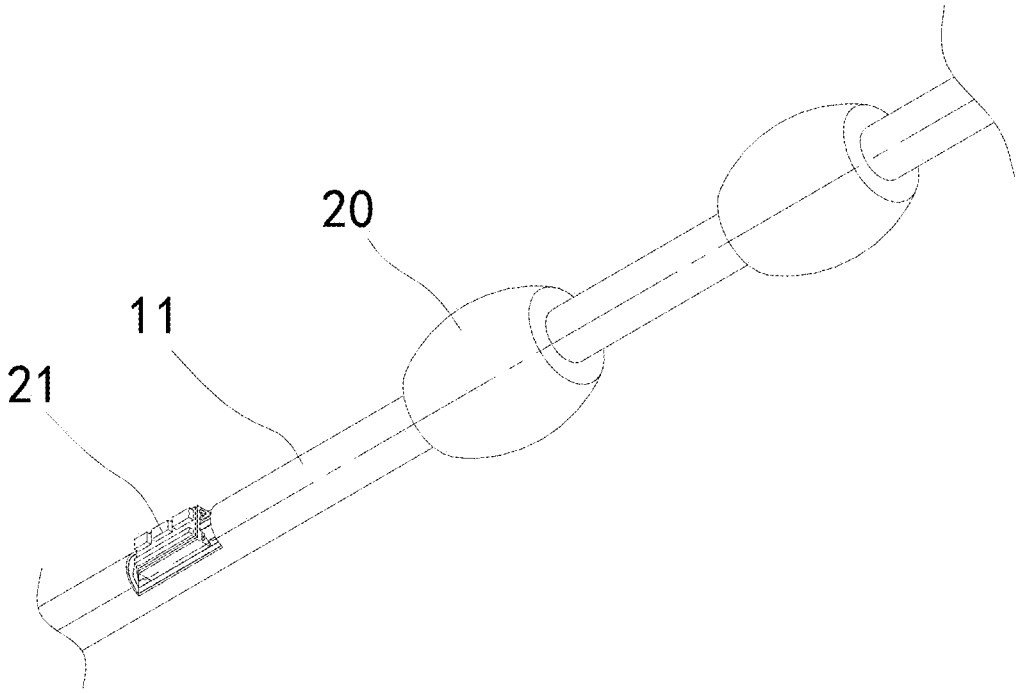
FIG. 10 is an axial view of a LED light string with single wire according to a seventh embodiment of the present disclosure.
Figure 11:
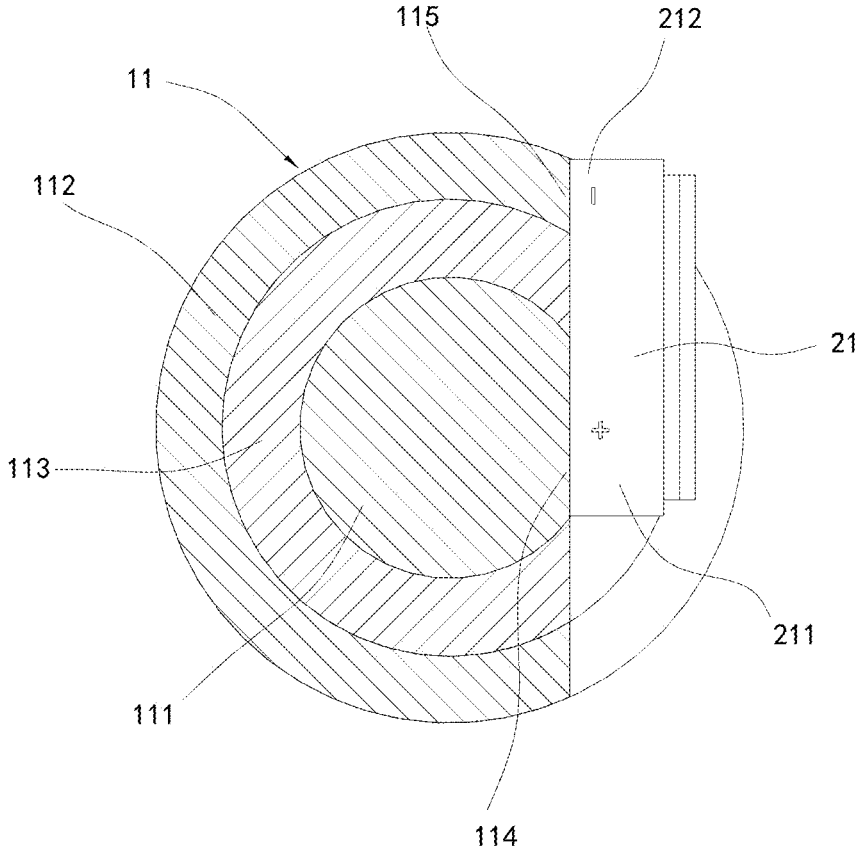
FIG. 11 is a cross-sectional view of the LED light string with single wire omitting an encapsulation colloid according to the seventh embodiment of the present disclosure.

FIG. 10 is an axial view of a LED light string with single wire according to a seventh embodiment of the present disclosure, and FIG. 11 is a cross-sectional view of the LED light string with single wire omitting the encapsulation colloid. As shown in FIGS. 10 and 11, the structure of the LED light string with single wire in the present embodiment is substantially the same as that of the LED light string in the first embodiment, except that the first conductor layer 111 and the second conductor layer 112 are arranged coaxially from inside out and from the center axis X. The portion, which locates on one or both sides of the central axis X and corresponds to the position of the light body 20, of the composite wire core 11 is profiled along the central axis X, to show the first conductor layer 111, the second conductor layer 112, the first welding portion 114, and the second welding portion 115. The positive electrode 211 and the negative electrode 212 of the patch LED light-emitting part 21 are electrically connected to the first welding portion 114 and the second welding portion 115, respectively. In the present embodiment, the number of the first conductor layer 111, the second conductor layer 112, and the insulation layer 113 is one, respectively. The first conductor layer 111 is located at the center, and the insulation layer 113 and the second conductor layer 112 are coated on the first conductor layer 111 in sequence. The portion, which locates on one side of the central axis X and corresponds to the position of the light body 20, of the composite wire core 11 is profiled along the central axis X, to show the first conductor layer 111, the second conductor layer 112, the first welding portion 114, and the second welding portion 115. The light body 20 includes a patch LED light-emitting part 21. The positive electrode 211 and the negative electrode 212 of the patch LED light-emitting part 1 are welded to the first welding portion 114 and the second welding portion 115, respectively.

Figure 12:
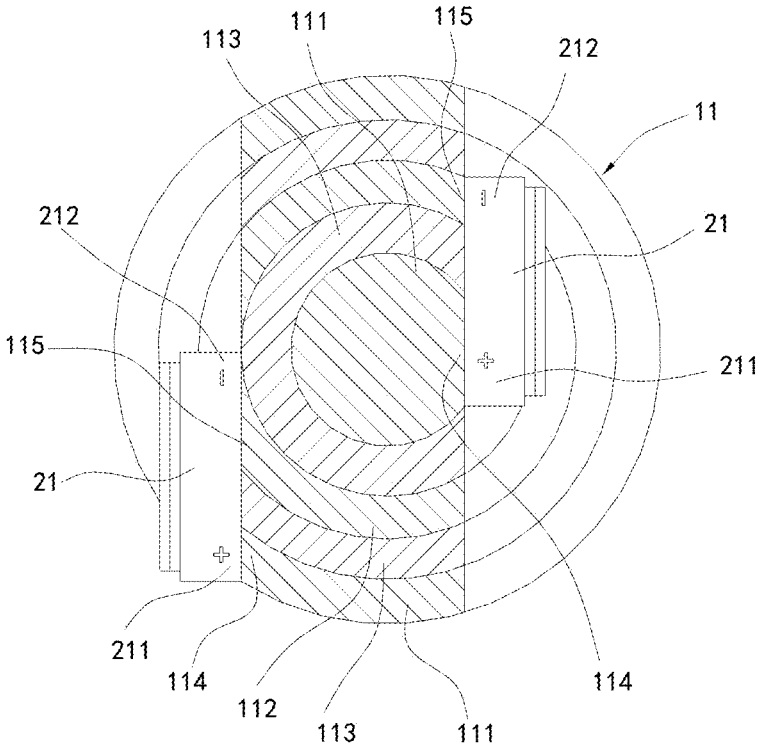
FIG. 12 is a cross-sectional view of a LED light string with single wire omitting an encapsulation colloid according to an eighth embodiment of the present disclosure.

FIG. 12 is a cross-sectional view of a LED light string with single wire omitting the encapsulation colloid 22 according to an eighth embodiment of the present disclosure. As shown in FIG. 12, the structure of the LED light string with single wire in the present embodiment is substantially the same as that of the LED light string in the seventh embodiment, except that in the present embodiment, both the numbers of the first conductor layer 111 and the insulation layer 113 are two, and the number of the second conductor layer 112 is one. The portion, which locates on both sides of the central axis X and corresponds to the position of the light body 20, of the composite wire core 11 is profiled along the central axis X, to show the first conductor layer 111, the second conductor layer 112, the first welding portion 114, and the second welding portion 115. The light body 20 includes two patch LED light-emitting part 21, which are located on both sides of the composite wire core 11, respectively. The positive electrode 211 of one patch LED light-emitting part 21 is electrically connected to the first welding portion 114 of a middle first conductor layer 111, and the negative electrode 212 thereof is electrically connected to the second welding portion 115 of the second conductor layer 112. The positive electrode 211 of another patch LED light-emitting part 21 is electrically connected to the first welding portion 114 of the outer first conductor layer 111, and the negative electrode 212 thereof is electrically connected to the second welding portion 115 of the second conductor layer 112.

Figure 13:
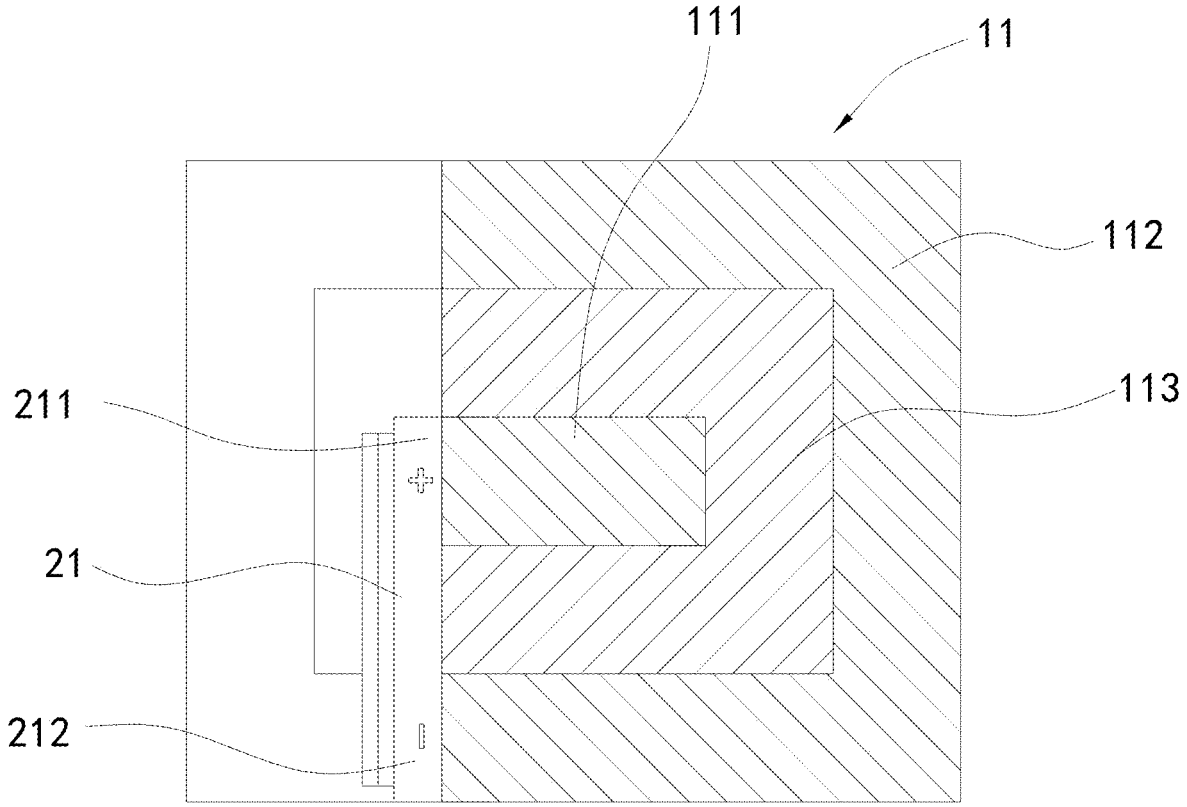
FIG. 13 is a cross-sectional view of a LED light string with single wire omitting an encapsulation colloid according to a ninth embodiment of the present disclosure.

FIG. 13 is a cross-sectional view of a LED light string with single wire omitting the encapsulation colloid 22 according to a ninth embodiment of the present disclosure. As shown in FIG. 9, the structure of the LED light string with single wire in the present embodiment is substantially the same as that of the LED light string in the seventh embodiment, except that the cross section of the composite wire core 11 is rectangular.

Figure 14:
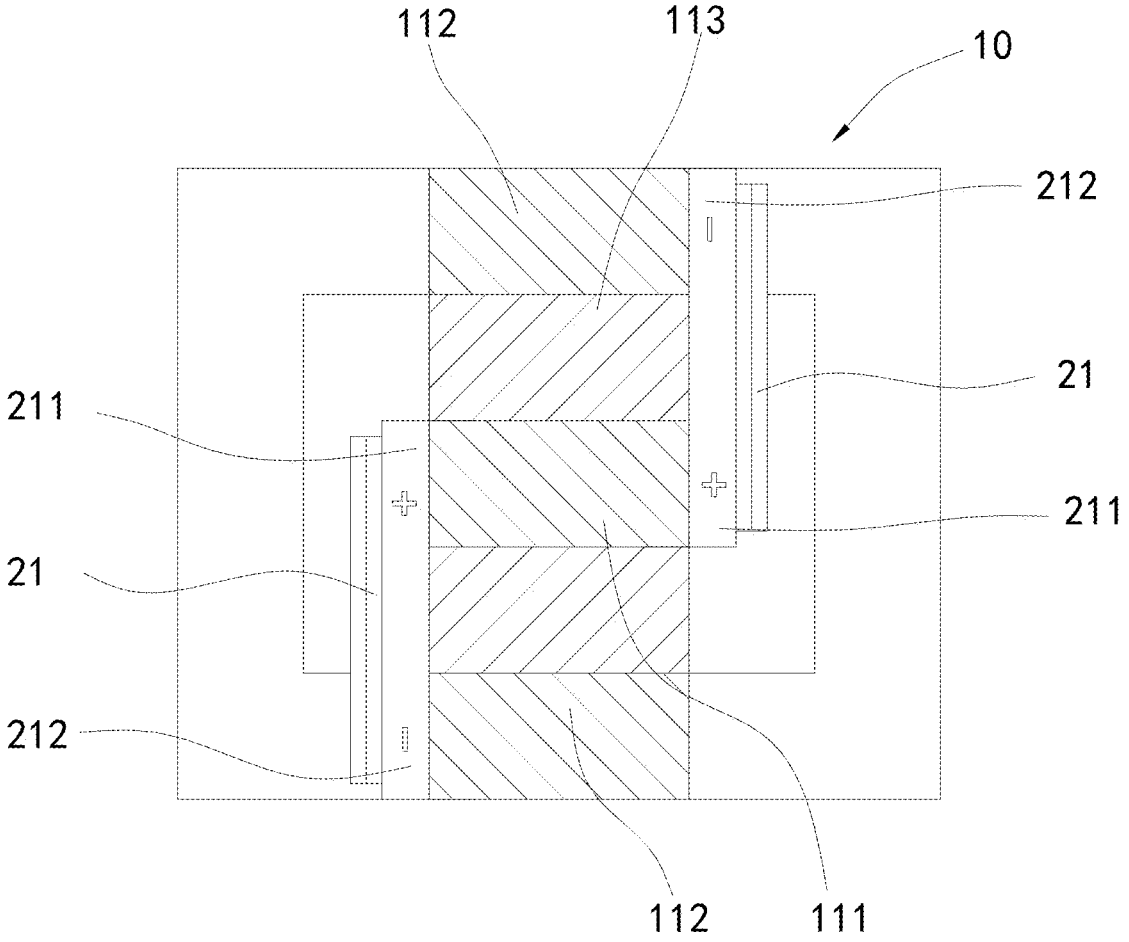
FIG. 14 is a cross-sectional view of a LED light string with single wire omitting an encapsulation colloid according to a tenth embodiment of the present disclosure.

FIG. 14 is a cross-sectional view of a LED light string with single wire omitting the encapsulation colloid 22 according to a tenth embodiment of the present disclosure. As shown in FIG. 14, the structure of the LED light string with single wire in the present embodiment is substantially the same as that of the LED light string in the eighth embodiment, except that the cross section of the composite wire core 11 is rectangular.

Figure 15:
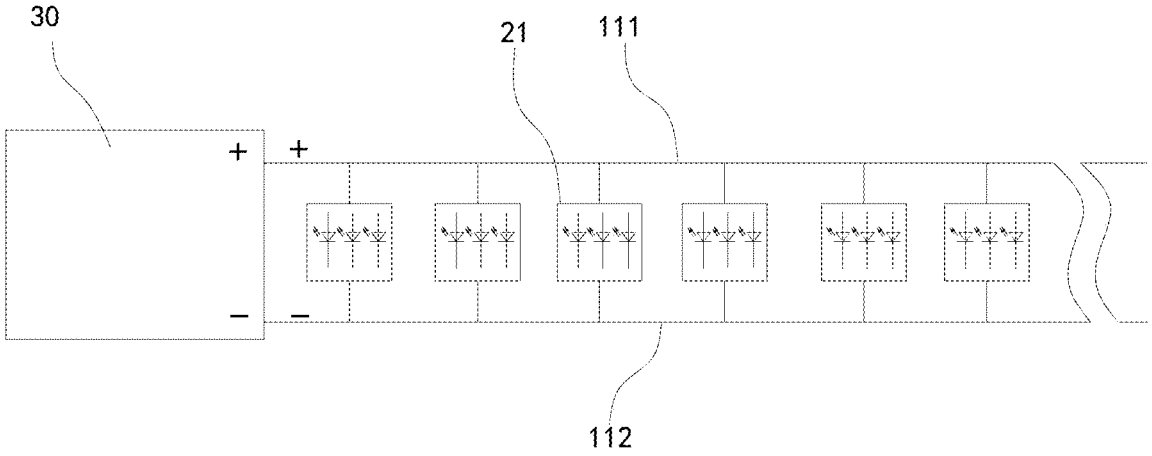
FIG. 15 is a schematic structural view of an illumination device of the LED light string with single wire shown in FIG. 1.

In another embodiment of the present disclosure, an illumination device is provided. As show in FIG. 15, the illumination device includes a control box 30 and the LED light string with single wire in the first to ninth embodiments described above. The outputs of the control box 30 are connected to the first conductor layer 111 and the second conductor layer 112 of the LED light string, respectively. The control box 30 provides a drive voltage and a control signal for the LED light string.

Figure 16:
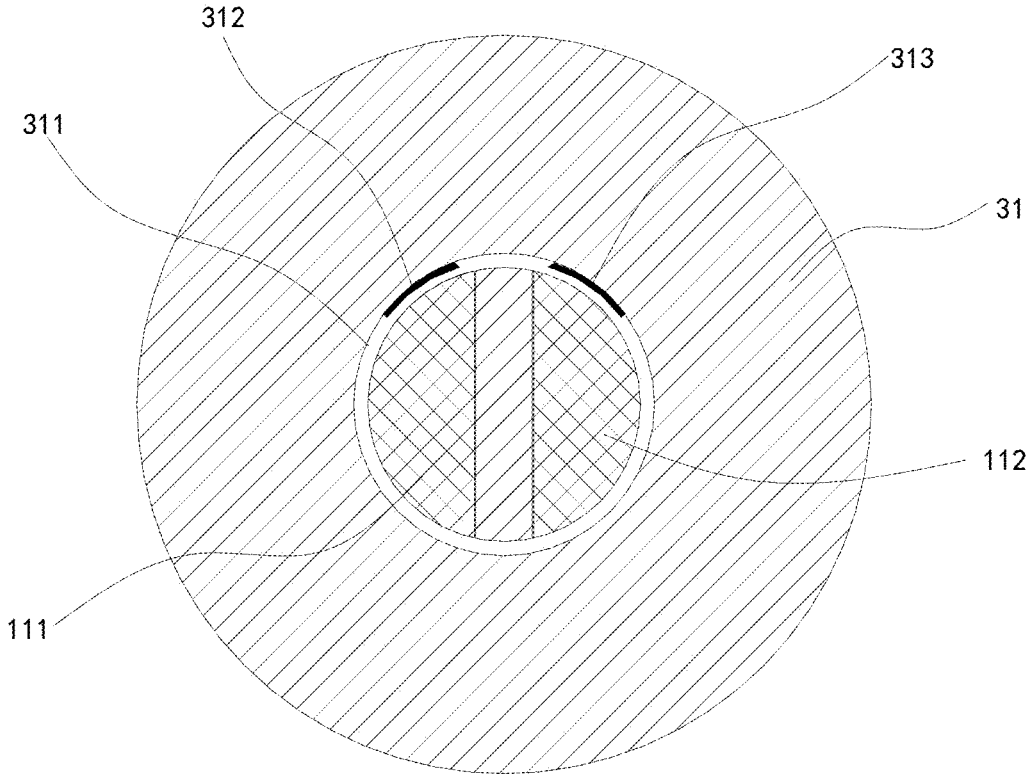
FIG. 16 is a schematic view of a connection between the wire of the LED light string and a control box.

As shown in FIG. 16, preferably, the control box 30 includes a connection circuit board 31 provided with at least one first connection line (not shown), at least one second connection line (not shown), and a through hole 311. The shape of the through hole 311 matches the cross-sectional shape of the wires. An inner wall of the through hole 311 is provided with at least one first conductive portion 312 conducting to the at least one first connection line and at least one second conductive portion 313 conducting to the at least one second connection line. One end of the wire of the LED light string is inserted into the through hole 311, and the at least one first conductor layer 111 and the at least one second conductor layer 112 of the wire are welded to the at least one first conductive portion 312 and the at least one second conductive portion 313, respectively. Due to such connection between the LED light string and the control box 30, it has the advantages of simple structure, low cost, and high assembly efficiency.

The above-described embodiments are only several implementations of the present disclosure, and the descriptions are relatively specific and detailed, but they should not be construed as limiting the scope of the present disclosure. It should be understood by those of ordinary skill in the art that various modifications and improvements can be made without departing from the concept of the present disclosure, and all fall within the protection scope of the present disclosure.

What is claimed is:

1. An illumination device, comprising:

an LED string light with a single wire comprising:

one wire comprising a composite wire core; the composite wire core being composed of at least one first conductor layer extending in an axial direction of the wire, at least one second conductor layer extending in the axial direction of the wire, and an insulation layer therebetween; and a plurality of light bodies arranged spaced away at set intervals along the axial direction of the wire; each of the light bodies comprising at least one patch LED light-emitting part and an encapsulation colloid coated on a surface of the at least one patch LED light-emitting part; a positive electrode and a negative electrode of the at least one patch LED light-emitting part being electrically connected to the at least one first conductor layer and the at least one second conductor layer, respectively;

a control box comprising:

a connection circuit board provided with at least one first connection line, at least one second connection line, and a through hole; an inner wall of the through hole is provided with at least one first conductive portion conducting to the at least one first connection line and at least one second conductive portion conducting to the at least one second connection line; one end of the wire of the LED string light is inserted into the through hole, and the at least one first conductor layer and the at least one second conductor layer of the wire are welded to the at least one first conductive portion and the at least one second conductive portion, respectively;

wherein a positive electrode output and a negative electrode output of the control box are electrically connected to the at least one first conductor layer and the at least one second conductor layer of the LED string light, respectively.

2. The illumination device according to claim 1, wherein the at least one first conductor layer and the at least one second conductor layer are arranged in a direction perpendicular to the axial direction of the wire.

3. The illumination device according to claim 2, wherein the at least one patch LED light-emitting part of the light bodies are located on a same side or on opposites sides of the composite wire core, respectively; one or more first polarities of the positive electrodes of the patch LED light-emitting parts on the same side are identical or opposite, and one or more second polarities of the negative electrodes of the patch LED light-emitting parts on the same side are identical or opposite.

4. The illumination device according to claim 1, wherein the at least one first conductor layer and the at least one second conductor layer are arranged in a circumferential direction centered on a central axis of the wire.

5. The illumination device according to claim 4, wherein each of the light bodies comprises two or more patch LED light-emitting parts; and the two or more patch LED light-emitting parts are arranged in the circumferential direction centered on the central axis of the wire.

6. The illumination device according to claim 1, wherein the at least one first conductor layer and the at least one second conductor layer are arranged coaxially from inside out and from a central axis of the wire.

7. The illumination device according to claim 6, wherein a portion, which locates on one or both sides of the central axis of the wire and corresponds to the position of the light body, of the composite wire core is profiled along the axial direction of the wire, to show the first conductor layer and the second conductor layer to form a first welding portion and a second welding portion, respectively; the positive electrode and the negative electrode of the patch LED light-emitting part are electrically connected to the first welding portion and the second welding portion, respectively.

8. The illumination device according to claim 1, wherein a cross-section of the composite wire core is circular, elliptical, polygonal, or rectangular.

9. The illumination device according to claim 1, wherein a surface of the patch LED light-emitting part facing the composite wire core is provided with a recess that matches a surface shape of the composite wire core.

10. The illumination device according to claim 1, wherein one or more first materials of the first conductor layer and the second conductor layer are Cu, Al, Ag, or an alloy thereof; and a second material of the insulation layer is a non-metal or a metal oxide.

11. The illumination device according to claim 1, wherein the wire further comprises an insulation sheath coated on part or all of a surface of the composite wire core.

12. The illumination device according to claim 11, wherein a material of the insulation sheath is insulation paint or insulation plastic.

13. The illumination device according to claim 1, wherein the patch LED light-emitting part is a LED, an ICLED, or a HVLED.

14. The illumination device according to claim 1, further comprising a plurality of decorative parts; the plurality of decorative parts are partially or fully transparent or translucent, and are coated on the plurality of light bodies, respectively.

* * * * *